United States Patent [19]

Burns et al.

[11] 4,444,567

[45] Apr. 24, 1984

[54] MOTOR FUEL COMPOSITION CONTAINING AN ASHLESS ANTIKNOCK AGENT

[75] Inventors: Lyle D. Burns; Robert M. Parlman, both of Bartlesville, Okla.

[73] Assignee: Phillips Petroleum Company, Bartlesville, Okla.

[21] Appl. No.: 480,962

[22] Filed: Mar. 31, 1983

Related U.S. Application Data

[63] Continuation-in-part of Ser. No. 394,214, Jul. 1, 1982, abandoned.

[51] Int. Cl.[3] ..... C10L 1/18

[52] U.S. Cl. ..... 44/78; 252/386

[58] Field of Search ..... 252/386; 44/78; 568/441; 560/103

[56] References Cited

U.S. PATENT DOCUMENTS

| | | | |
|---|---|---|---|
| 1,807,693 | 6/1931 | Kalischer et al. | 568/441 |
| 1,860,092 | 5/1932 | Graves | 560/103 |
| 2,334,006 | 11/1943 | Holm | 44/70 |
| 3,151,956 | 10/1964 | Younghouse | 44/78 |
| 3,156,542 | 10/1964 | Younghouse | 44/78 |
| 3,592,950 | 8/1971 | Orloff | 260/613 |
| 3,696,141 | 10/1972 | Hulsmann | 560/103 |
| 3,919,094 | 11/1975 | Schiff | 252/33 |
| 4,312,636 | 1/1982 | Singerman | 44/53 |
| 4,323,694 | 4/1982 | Scala, Jr. | 560/103 |

*Primary Examiner*—Charles F. Warren
*Assistant Examiner*—Y. Harris-Smith

[57] ABSTRACT

Liquid hydrocarbon fuel compositions are provided containing antiknock quantities of ashless antiknock agents comprising selected alkoxy-substituted benzaldehydes and alkoxy-substituted benzoic esters.

17 Claims, No Drawings

MOTOR FUEL COMPOSITION CONTAINING AN ASHLESS ANTIKNOCK AGENT

This is a continuation-in-part of our application having Ser. No. 394,214, filed July 1, 1982, now abandoned.

This invention relates to liquid hydrocarbon fuel compositions having improved antiknock properties. In one of its aspects, this invention relates more particularly to liquid hydrocarbon fuel compositions intended for use in internal combustion engines containing novel and effective ashless antiknock agents. In accordance with a further aspect, this invention relates to liquid hydrocarbon compositions containing antiknock quantities of ashless antiknock agents selected from alkoxy-substituted benzaldehydes and alkoxy-substituted benzoic esters.

Various antiknock agents have, heretofore, been suggested and employed for use in liquid hydrocarbon fuels, particularly in fuels employed in internal combustion engines. In such engines, it is highly desirable, from a stand point of economics that combustion of the fuel occurs at relatively high compression ratios. Such high compression ratios concomitantly necessitate the use of fuels having relatively high octane numbers to insure knock-free operation. Many antiknock agents have been proposed and/or used to improve the antiknock properties of hydrocarbon fuels used for internal combustion engines. In general, however, none of these antiknock additives have proved to be satisfactory in effectively raising the octane number of the fuel without also exhibiting other undesirable properties of varying importance. The phase-down of lead in gasoline as required by federal law and the banning of certain additives from use in unleaded gasoline has given impetus to continuation of a systematic study of the antiknock activity of ashless (non-metallic) compounds. The present invention is directed to the use of ashless (non-metallic) additives as antiknock agents for internal combustion fuels.

Accordingly, an object of this invention is to provide ashless hydrocarbon fuel compositions.

Another object of this invention is to provide ashless (non-metallic) antiknock additives for internal combustion engine fuels.

Another object of this invention is to provide hydrocarbon fuel compositions exhibiting improved antiknock properties.

Other objects, aspects, as well as the several advantages of the invention will be apparent to those skilled in the art upon reading the specification and the appended claims.

In accordance with the invention set forth in said copending application, new and improved liquid hydrocarbon fuel compositions are provided containing an antiknock improving quantity of ashless (non-metallic) antiknock additives selected from alkoxy-substituted benzaldehydes.

In accordance with the present invention, new and improved liquid hydrocarbon fuel compositions are provided containing an antiknock improving quantity of ashless (non-metallic) antiknock additives selected from alkoxy-substituted benzoic esters.

The antiknock additives of the invention are known and can be prepared by processes known in the art.

The alkoxy-substituted benzaldehyde are characterized by the formula:

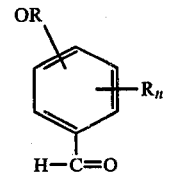

(a)

wherein each R may be the same or different and is a straight or branched chain alkyl substituent, preferably straight chain, having from 1 to 4, inclusive, carbon atoms and n is 0, 1 or 2.

Specific examples of alkoxy-substituted benzaldehyde ashless antiknock agents of the invention that can be used in internal combustion engine fuels include p-anisaldehyde, m-anisaldehyde, o-anisaldehyde, 2-methyl-p-anisaldehyde, 3-methyl-p-anisaldehyde, 2-methyl-m-anisaldehyde, 4-methyl-m-anisaldehyde, 5-methyl-m-anisaldehyde, 6-methyl-m-anisaldehyde, 3-methyl-o-anisaldehyde, 4-methyl-o-anisaldehyde, 5-methyl-o-anisaldehyde, 6-methyl-o-anisaldehyde, 2,3-dimethyl-p-anisaldehyde, 2,5-dimethyl-p-anisaldehyde, 2,4-dimethyl, 2,5-dimethyl, 2,6-dimethyl-, 4,5-dimethyl-, and 5,6-dimethyl-m-anisaldehyde, and the like, and mixtures thereof, and structurally closely related compounds. A presently preferred compound is p-anisaldehyde. These compounds have suitable solubility and volatility characteristics to permit their application as additives for hydrocarbon fuels.

The alkoxy-substituted benzoic esters are characterized by the formula:

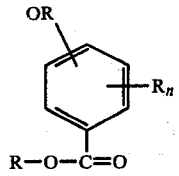

(b)

wherein each R and n is as defined above.

Representative examples of alkoxy-substituted benzoic ester ashless antiknock agents of the invention that can be used in internal combustion engines include:

methyl 4-methoxybenzoate,
ethyl 4-methoxybenzoate (ethyl anisate),
methyl 2-methylanisate,
methyl 3-methylanisate,
methyl 2-ethylanisate,
n-butyl anisate,
methyl 4-ethoxybenzoate
ethyl 2-methylanisate,
ethyl 3-methylanisate,
ethyl 2-ethylanisate,
methyl 2,3-dimethylanisate,
methyl 2,5-dimethylanisate,
methyl 2,5-diethylanisate,
methyl 2,6-dimethylanisate,
methyl 3,5-dimethylanisate,
methyl 3-methyl-5-ethylanisate,
ethyl-3-ethoxybenzoate,
ethyl 4-ethoxybenzoate,
n-butyl 4-ethoxybenzoate,
ethyl-2-ethoxybenzoate,
ethyl 2-ethoxy-4-methylbenzoate,
methyl 4-isopropoxybenzoate,
methyl 4-n-butoxybenzoate, t-butyl 4-methoxybenzoate
isopropyl anisate,
t-butyl anisate,
ethylene dianisate,
ethylene bis(4-ethoxybenzoate), and the like, and mixtures thereof, and structurally closely related compounds. Presently preferred compounds are methylanisate and ethylanisate.

The specific antiknock additives of the invention are highly suited for use in fuels in view of their ashless characteristics. Naturally, the various compounds of the herein disclosed group do not possess exactly identical effectiveness, and the most advantageous concentration for each such compound will depend to some extent upon the particular compound used. Also, the minimum effective concentration can vary somewhat according to the specific nature of the hydrocarbon composition to which it is added.

The amounts of the antiknock agents of the invention added to the hydrocarbon fuels will be sufficient to improve the antiknock properties of the fuel. In general, these novel antiknock additives are employed in amounts from about 0.5 to about 15 percent (5000 to 150,000 parts per million), preferably from about 1 to about 5 percent (10,000 to 50,000 parts per million), by weight of the total weight of the fuel composition.

The motor fuels or gasolines into which the invention additives are incorporated are conventional liquid hydrocarbon motor fuel distillates boiling in the range of about 70°–420° F. (21.1°–216° C.). Gasolines or automotive fuels in which the described additives perform the functions described herein include substantially all grades of gasoline presently being employed in automotive and internal combustion aircraft engines. Generally automotive and aircraft gasolines contain both straight run and cracked stock with or without alkylated hydrocarbons, reformed hydrocarbons, and the like. Such gasolines can be prepared from saturated hydrocarbons, e.g., straight run stocks, alkylation products, and the like, with or without gum inhibitors, detergents, corrosion inhibitors, solvents, emulsifiers, and the like. The motor fuels are unleaded and can contain other conventional fuel additives such as antioxidants and the like.

SPECIFIC EXAMPLES

EXAMPLE I

Solutions of para-anisaldehyde in clear (unleaded) FT-266 gasoline were prepared. The following table presents the characteristics of FT-266 gasoline.

CHARACTERISTICS OF TEST GASOLINE

Description: Unleaded Kansas City Premium Pipeline Base Gasoline

| Designation | FT-266 |
|---|---|
| Reid Vapor Pressure, psi | 5.7 |
| API Gravity @ 60 F. | 60.3 |
| ASTM Distillation | |
| Vol % Evaporated | Temp., F. |
| IBP | 102 |
| 5 | 142 |
| 10 | 164 |
| 15 | 178 |
| 20 | 190 |
| 30 | 210 |
| 40 | 224 |
| 50 | 235 |
| 60 | 247 |
| 70 | 264 |
| 80 | 292 |
| 90 | 335 |
| 95 | 373 |
| EP | 431 |
| Research Octane Number | 91.7 |
| Motor Octane Number | 84.1 |

The treated and untreated gasoline was engine tested to determine its Research Octane Number (RON) according to ASTM D 2599-47. The increase in RON over the untreated fuel produced by the addition of the additive compound is set forth in the table below.

| Additive Conc. Wgt. % | RON Increase |
|---|---|
| 0 | 0 |
| 3.8 | 1.6 |
| 7.6 | 2.8 |
| 11.3 | 4.1 |

(a) Based on total fuel composition. Ortho- and meta-anisaldehyde were tested and found to be not fully soluble in gasoline at the upper concentrations used for p-anisaldehyde and also were found to have lower octane increasing values of 2.4 for m-anisaldehyde and 0.9 for o-anisaldehyde at 7.6 wgt % of additive.

EXAMPLE II

Several concentrations of alkyl alkoxybenzoic esters in FT-266, premium pipeline base gasoline, were prepared and compared with equal concentrations of other known octane improvers. The results are shown in the table. The first three additives are examples of the invention. Results are shown in the table.

TABLE

INCREASE IN RESEARCH OCTANE NUMBER (Δ RON)

| | Δ RON | | |
|---|---|---|---|
| Additive concentration in FT-266 (Vol. %): | 2.5 | 5.0 | 7.5 |
| methyl anisate p-$CH_3O—C_6H_4—CO_2CH_3$ | 0.5* | 1.3** | — |
| ethyl anisate p-$CH_3O—C_6H_4—CO_2CH_2CH_3$ | 1.8 | 2.0 | 2.6 |
| ethyl-4-ethoxybenzoate p-$CH_3CH_2O—C_6H_4—CO_2CH_2CH_3$ | 0.4 | 1.4 | 2.1 |
| methyl-t-butylether $(CH_3)_3COCH_3$ | 0.4 | 1.6 | 2.8 |
| p-methylanisole p-$CH_3O—C_6H_4—CH_3$[a] | — | 1.5 | — |
| t-butylacetate $CH_3CO_2C(CH_3)_3$[b] | 0.2 | 1.0 | 2.2 |

*Δ RON with conc. of 2.5 g/100 ml fuel
**Δ RON with one of 5.0 g/100 ml fuel
[a]cited in U.S. Pat. No. 4,312,636
[b]cited in U.S. Pat. No. 2,334,006

These results show the inventive compositions (the first three above) are comparable or superior to known octane improvers (the last three above).

The efficacy of the novel ashless antiknock compounds of the present invention for improving the antiknock properties of liquid hydrocarbon fuels will be apparent from the foregoing examples and comparative data. It will be understood that the novel ashless antiknock compounds of the present invention can be advantageously employed in any liquid hydrocarbon fuel composition which is suitable for use in a combustion engine regardless of the purpose for which the engine is designated.

We claim:

1. An internal combustion fuel composition comprising a liquid hydrocarbon motor fuel containing a small but effective amount, sufficient to impart reduced knocking tendencies to said motor fuel, of at least one ashless antiknock additive characterized by the formulae:

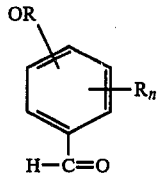

(a)

and

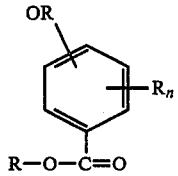

(b)

wherein each R can be the same or different and is a straight or branched chain alkyl substituent having from 1 to 4, inclusive, carbon atoms and n is 0, 1, or 2.

2. A composition according to claim 1 wherein said additive is an alkoxy-substituted benzaldehyde having formula (a).

3. A composition according to claim 2 wherein said additive is p-anisaldehyde, m-anisaldehyde, or o-anisaldehyde.

4. A composition according to claim 1 wherein the motor fuel contains from about 0.5 to about 15 wt. % of said additive based on total fuel composition.

5. A composition according to claim 1 wherein said motor fuel is a distillate boiling in the range of about 70° F. to about 420° F.

6. A composition according to claim 1 wherein said motor fuel is unleaded gasoline containing p-anisaldehyde.

7. A composition according to claim 6 wherein p-anisaldehyde is present in said gasoline in the range of about 0.5 to about 15 wt. %.

8. A composition according to claim 1 wherein said additive is an alkoxy-substituted benzoic acid ester having formula (b).

9. A composition according to claim 8 wherein said additive is ethyl 4-ethoxybenzoate,
methyl 4-ethoxybenzoate,
methyl 4-methoxybenzoate, or
ethyl 4-methoxybenzoate.

10. A composition according to claim 1 wherein said motor fuel is unleaded gasoline containing methyl p-methoxybenzoate.

11. A composition according to claim 10 wherein said additive is present in said gasoline in the range of about 0.5 to about 15 weight percent.

12. A method for improving the antiknock properties of a motor fuel which comprises incorporating therein a small but effective amount sufficient to impart reduced knocking tendencies to said motor fuel of at least one ashless antiknock additive characterized by the formulae:

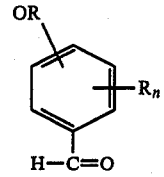

(a)

and

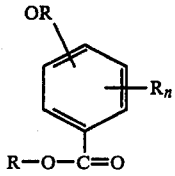

(b)

wherein each R can be the same or different and is a straight or branched chain alkyl substituent having from 1 to 4, inclusive, carbon atoms and n is 0, 1, or 2.

13. A method according to claim 12 wherein said motor fuel is unleaded and contains from about 0.5 to about 15 weight percent of the additive.

14. A method according to claim 12 wherein said motor fuel is unleaded gasoline and said additive is p-anisaldehyde.

15. A method according to claim 12 wherein said additive is p-anisaldehyde, m-anisaldehyde, or o-anisaldehyde.

16. A method according to claim 12 wherein said additive is ethyl 4-ethoxybenzoate,
methyl 4-ethoxybenzoate,
methyl 4-methoxybenzoate, or
ethyl 4-methoxybenzoate.

17. A method according to claim 12 wherein said motor fuel is unleaded gasoline and said additive is ethyl 4-methoxybenzoate.

* * * * *